US010823446B2

(12) United States Patent
Yang et al.

(10) Patent No.: US 10,823,446 B2
(45) Date of Patent: Nov. 3, 2020

(54) SYSTEM OF ADJUSTING LOAD OF AIR CONDITIONING AND METHOD OF ADJUSTING THE SAME

(71) Applicant: Chicony Power Technology Co., Ltd., New Taipei (TW)

(72) Inventors: Shen-Min Yang, New Taipei (TW); Cheng-Yi Ho, New Taipei (TW); Wen-Yen Cheng, New Taipei (TW); Te-Mei Tu, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/546,292

(22) Filed: Aug. 20, 2019

(65) Prior Publication Data

US 2020/0116382 A1 Apr. 16, 2020

Related U.S. Application Data

(63) Continuation-in-part of application No. 16/226,228, filed on Dec. 19, 2018.

(30) Foreign Application Priority Data

Oct. 12, 2018 (TW) ..... 107136027 A
Jun. 20, 2019 (TW) ..... 108121583 A

(51) Int. Cl.
*F24F 11/00* (2018.01)
*F24F 11/76* (2018.01)
(Continued)

(52) U.S. Cl.
CPC ..... *F24F 11/76* (2018.01); *F24F 11/46* (2018.01); *F24F 11/63* (2018.01)

(58) Field of Classification Search
CPC .. F24F 11/46; F24F 11/63; F24F 11/64; F24F 11/76
See application file for complete search history.

(56) References Cited

U.S. PATENT DOCUMENTS 6,158,541 A 12/2000 Tabata et al.
6,185,483 B1 2/2001 Drees
2018/0066860 A1* 3/2018 Carlson ..... G05B 15/02

FOREIGN PATENT DOCUMENTS

CN 102193528 A 9/2011
CN 103499136 A 1/2014
(Continued)

OTHER PUBLICATIONS

Office Action dated Oct. 17, 2019 of the corresponding Taiwan patent application No. 108121583.

*Primary Examiner* — Jonathan Bradford
(74) *Attorney, Agent, or Firm* — Chun-Ming Shih; HDLS IPR Services

(57) ABSTRACT

A system is disclosed and includes an air-conditioning load prediction unit for predicting a load of an air-conditioning unit in a future time period based on past data; an indoor temperature and humidity sensing module for sensing temperature and humidity of a building at a first time; a fan-speed sensing module for sensing a fan-speed of the air-conditioning unit at the first time; and a comfort-degree prediction module for calculating a comfort-degree that the air-conditioning unit is required to reach at a second time based on the sensed temperature, sensed humidity and sensed fan-speed; an energy management unit for controlling a central monitoring computer to set a temperature and an fan-speed of the air conditioning unit, and compare the predicted load and an actual load of the air conditioning unit for adjusting the set temperature and the set fan-speed in real time. A method of adjusting is also provided.

20 Claims, 8 Drawing Sheets

(51) Int. Cl.
*F24F 11/46* (2018.01)
*F24F 11/63* (2018.01)

(56) References Cited

FOREIGN PATENT DOCUMENTS

| | | | |
|---|---|---|---|
| CN | 103574845 | A | 2/2014 |
| CN | 104950720 | A | 9/2015 |
| CN | 105157183 | A | 12/2015 |
| CN | 105387565 | A | 3/2016 |
| CN | 106403166 | A | 2/2017 |
| CN | 205980188 | U | 2/2017 |
| CN | 107781947 | A | 3/2018 |
| TW | 201102945 | A | 1/2011 |

* cited by examiner

SYSTEM OF ADJUSTING LOAD OF AIR CONDITIONING AND METHOD OF ADJUSTING THE SAME

CROSS REFERENCE TO RELATED APPLICATION

This application is a Continuation-in-Part of co-pending application Ser. No. 16/226,228, filed on Dec. 19, 2018, which claims priority to Taiwan Patent Application No. 107136027, filed on Oct. 12, 2018. The entire contents of which are hereby incorporated by reference.

BACKGROUND OF THE INVENTION

1. Technical Field

The technical field relates to air conditioning, and more particularly relates to a system of adjusting load of air conditioning and a method of adjusting load of air conditioning.

2. Description of Related Art

Conventionally, a large air conditioning unit is equipped with a water chiller which makes chilled water at off-peak time having low electricity prices for saving money. Thus, the air conditioning unit may use the chilled water for heat exchange at peak time having high electricity prices for saving both energy and money.

Typically, a water chiller has a limited chilled water storage in process equipment. It is understood that for a building there are internal factors (e.g., the number of occupants or an event to be held in the building) and external factors (e.g., temperature or humidity) are included in consideration of the comfort-degree and these factors are different from day to day. However, the stored chilled water may be insufficient if the air conditioning unit is controlled to keep a desired comfort-degree all day long.

In case of insufficient chilled water storage (i.e., an actual load of the air conditioning unit being greater than a predicted load thereof), the air conditioning unit activates the water chiller to make chilled water again. However, the process may be occurred at peak time having high electricity prices and the process may consume more power as stipulated in a contract involved the building having the air conditioning unit and a power company.

Further, in case of a sharp change of interior environment (e.g., a sudden increase of temperature in the building), the air conditioning unit activates the water chiller to make more chilled water to improve comfort of occupants. In such scenario, the water chiller may run at a sharp range over an efficiently range which is 60% to 80% of its full load, resulting in a sharp increase of the power consumption.

Thus, the need for improvement still exists.

SUMMARY OF THE INVENTION

The disclosure is directed to a system of adjusting load of air conditioning and a method of adjusting same so that a desired comfort-degree can be kept, an optimum control of an air conditioning unit is carried out by correctly predicting load, energy is saved, and power consumption at peak time is decreased.

It is therefore one object of the invention to provide a system of adjusting load of air conditioning of a building, comprising a central monitoring computer; an energy management unit; an air conditioning load prediction unit connected to the central monitoring computer via the energy management unit, configured to predict a load of an air conditioning unit at a future time period based on data obtained from a past time period, and send the predicted load to the energy management unit; an indoor temperature and humidity sensing module configured to sense both a temperature and a humidity of a building at a first time and output both the sensed temperature and the sensed humidity; a fan speed sensing module configured to sense a fan speed of the air conditioning unit at the first time and output the sensed fan speed; and a comfort-degree prediction module connected to the central monitoring computer via the energy management unit, configured to calculate predetermined indoor comfort-degree that the air conditioning unit is required to reach at a second time based on the sensed temperature, the sensed humidity, and the sensed fan speed, and send the predetermined indoor comfort-degree to the energy management unit, wherein the second time is later than the first time and the second time is within the future time period; wherein the energy management unit instructs the central monitoring computer to set both a temperature and a fan speed of the air conditioning unit based on the predetermined indoor comfort-degree; and wherein in response to the air conditioning unit running at the set temperature and the set fan speed, the central monitoring computer compares the predicted load with an actual load of the air conditioning unit to obtain a comparison result which is configured to adjust the set temperature and the set fan speed of the air conditioning unit in real time.

It is another object of the invention to provide a method of adjusting load of air conditioning of a building by controlling an air conditioning unit of the building, comprising the steps of a) activating an air conditioning load prediction unit to predict a load of the air conditioning unit at a future time period based on data obtained from a past time period; b) activating an indoor temperature and humidity sensing module to sense both a temperature and a humidity of the building at a first time; c) activating a fan speed sensing module to sense a fan speed of the air conditioning unit at the first time; d) activating a comfort-degree prediction module to calculate a predetermined indoor comfort-degree that the air conditioning unit is required to reach at a second time based on the sensed temperature, the sensed humidity, and the sensed fan speed, wherein the second time is later than the first time and the second time is within the future time period; e) activating an energy management unit to instruct a central monitoring computer to set both a temperature and a fan speed of the air conditioning unit based on the predetermined indoor comfort-degree; f) controlling the air conditioning unit to run at the set temperature and the set fan speed; and g) instructing the central monitoring computer to compare the predicted load with an actual load of the air conditioning unit to obtain a comparison result which is configured to adjust the set temperature and the set fan speed of the air conditioning unit in real time.

The invention has the following advantages and benefits in comparison with the conventional art: the air conditioning unit adjusts both a desired comfort-degree and control parameters in real time for the desired comfort-degree by predicting a load in a future-period of time, an optimum control of the air conditioning unit is carried out, energy is saved, and power consumption at peak time is decreased.

The above and other objects, features and advantages of the invention will become apparent from the following detailed description taken with the accompanying drawings.

DETAILED DESCRIPTION OF THE INVENTION

Embodiments of the invention will now be described, by way of example only, with reference to the accompanying drawings.

Figure 1:
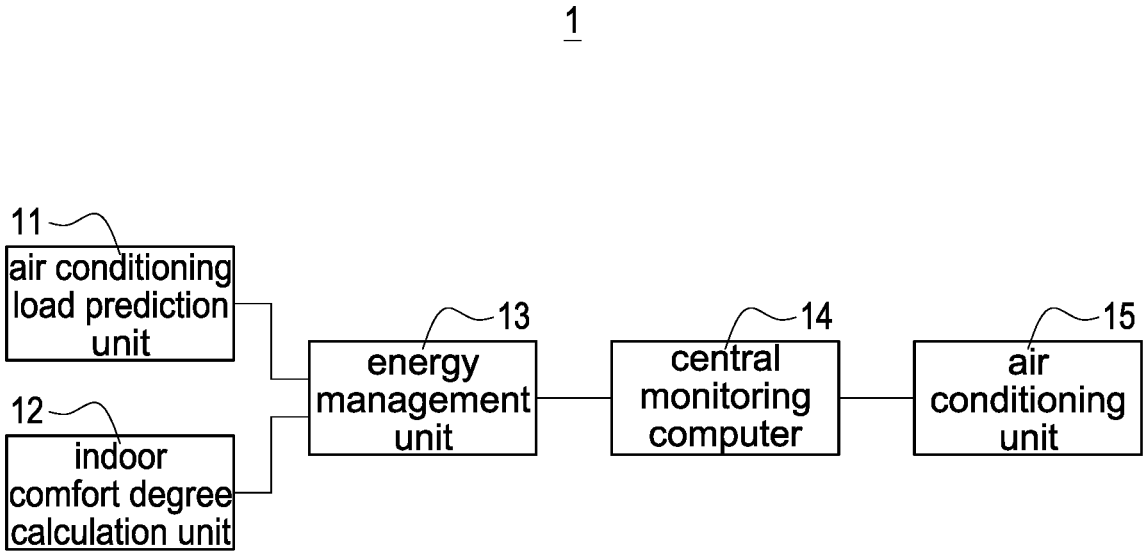
FIG. 1 is a block diagram of a system of adjusting load of air conditioning according to the invention.

Referring to FIG. 1, a system of adjusting load of air conditioning (hereinafter the adjustment system 1) in accordance with the invention comprises an air conditioning load prediction unit 11, an indoor comfort-degree calculation unit 12, an energy management unit 13, a central monitoring computer 14 and an air conditioning unit 15 as discussed in detail below. A building (not shown) is equipped with the air conditioning unit 15 which has a water chiller (not shown) to make chilled water. The chilled water is used for heat exchange purpose so that the comfort of environment/occupants in the building can be improved.

In an embodiment, the energy management unit 13 is connected to the air conditioning load prediction unit 11, the indoor comfort-degree calculation unit 12 and the central monitoring computer 14 respectively. The central monitoring computer 14 is connected to the air conditioning unit 15 by wire or wirelessly. The central monitoring computer 14 may monitor operating time, temperature setting and fan speed of the air conditioning unit 15 and adjust an operating mode of the air conditioning unit 15 based on parameters such as temperature and humidity.

In an embodiment of the invention, the air conditioning load prediction unit 11 may predict load of the air conditioning unit 15 at a predetermined future time period such as a day (hereinafter the predicted load) based on collected data and send the predicted load to the energy management unit 13. The energy management unit 13 may generate a control signal to control the central monitoring computer 14 based on the received predicted load. The central monitoring computer 14 may be controlled by the control signal to activate the water chiller of the air conditioning unit 15 to perform a storing operation for making chilled water and store same at a predetermined time period (e.g., off-peak time). Thus, the water chiller may store a sufficient volume of chilled water for the predicted load at the end of the storing operation. There is no problem of having insufficient volume of chilled water for the air conditioning unit 15 if the accumulated load of a day does not exceed the predicted load.

One technological characteristic of the invention is that the air conditioning load prediction unit 11 may access data generated in the past time period at the location (e.g., the building) and predict load of the air conditioning unit 15 at a predetermined future time period based on the data (hereinafter the predicted load). The air conditioning load prediction unit 11 may send the predicted load to the energy management unit 13. The energy management unit 13 may uses the predicted load as one of parameters for optimizing the control of the air conditioning unit 15.

In the embodiment, the past time period means a previous time period such as office hours of yesterday, office hours of today that has elapsed or the like. The predetermined future time period means a time period later such as office hours of tomorrow or 24 hours from the current time in a non-limiting manner.

Figure 2:
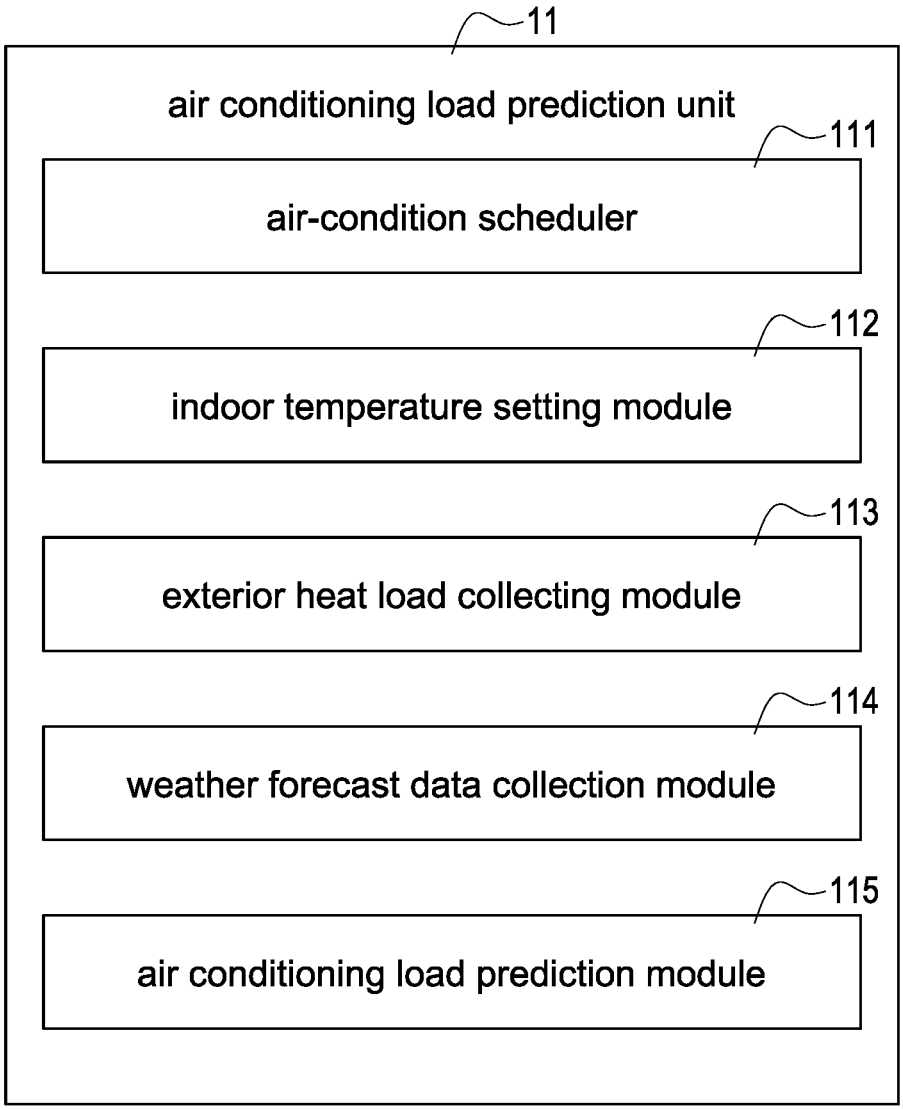
FIG. 2 is a detailed block diagram of the air conditioning load prediction unit.

Referring to FIG. 2, a detailed block diagram of the air conditioning load prediction unit 11 is shown. The air conditioning load prediction unit 11 may be a real unit (e.g., processor) or a virtual unit (e.g., one executed by software). As shown, the air conditioning load prediction unit 11 may include, for example, an air-condition scheduler 111, an indoor temperature setting module 112, an exterior heat load collecting module 113, a weather forecast data collection module 114 and an air conditioning load prediction module 115 according to the functions of the air conditioning load prediction unit 11.

In the embodiment, the air-condition scheduler 111 connects to the air conditioning unit 15, the central monitoring computer 14 or a building automation (BA) system (not shown) for communication so that schedule parameters of the air conditioning unit 15 in the past time period can be obtained. The indoor temperature setting module 112 connects to the air conditioning unit 15, the central monitoring computer 14 or one or more sensors (not shown) provided internally or externally of a building for communication so that a set of indoor temperature setting conditions of the building in the past time period can be obtained. The exterior heat load collecting module 113 connects to the central monitoring computer 14 or the BA system for communication so that exterior heat loads for the building in the past time period can be obtained.

The weather forecast data collection module 114 connects to the central monitoring computer 14 or the BA system for communication or the weather forecast data collection module 114 connects to the website of a weather bureau (e.g., Central Weather Bureau) via the Internet so that weather forecast data of a future time period including hourly outdoor temperature and hourly outdoor relative humidity can be obtained. In an embodiment, the weather forecast data collection module 114 obtains weather forecast data of a future time period at the location where the air conditioning unit 15 is arranged from the website of a weather bureau via the Internet but in a non-limiting manner.

The air conditioning load prediction module 115 obtains schedule parameters, indoor temperature setting conditions, exterior heat loads and weather forecast data from the air-condition scheduler 111, the indoor temperature setting module 112, the exterior heat load collecting module 113, and the weather forecast data collection module 114 respectively. The air conditioning unit 15 executes an algorithm to predict a potential air conditioning load in the future time period and generates a predicted load. Therefore, the adjustment system 1 of the invention may perform an optimum control of the air conditioning unit 15 based on the predicted load.

Another technological characteristic of the invention is that the adjustment system 1 may activate the indoor comfort-degree calculation unit 12 to calculate a predetermined indoor comfort-degree of a building that the air conditioning unit 15 has to reached at a second time based on the current conditions. The energy management unit 13 may adjust operations of the air conditioning unit 15 based on the predetermined indoor comfort-degree so that a more comfortable interior environment can be achieved. In the embodiment, the second time is later than the current time (hereinafter the first time) by 10 minutes, 1 hour, 3 hours, etc. in a non-limiting manner.

It is noted that the second time of the invention means a time point within the aforementioned future time period. For example, the second time is 3 hours from the current time if the future time period is 24 hours from the current time. But above is only a preferred embodiment of the invention and the invention is not limited to such.

Figure 3:
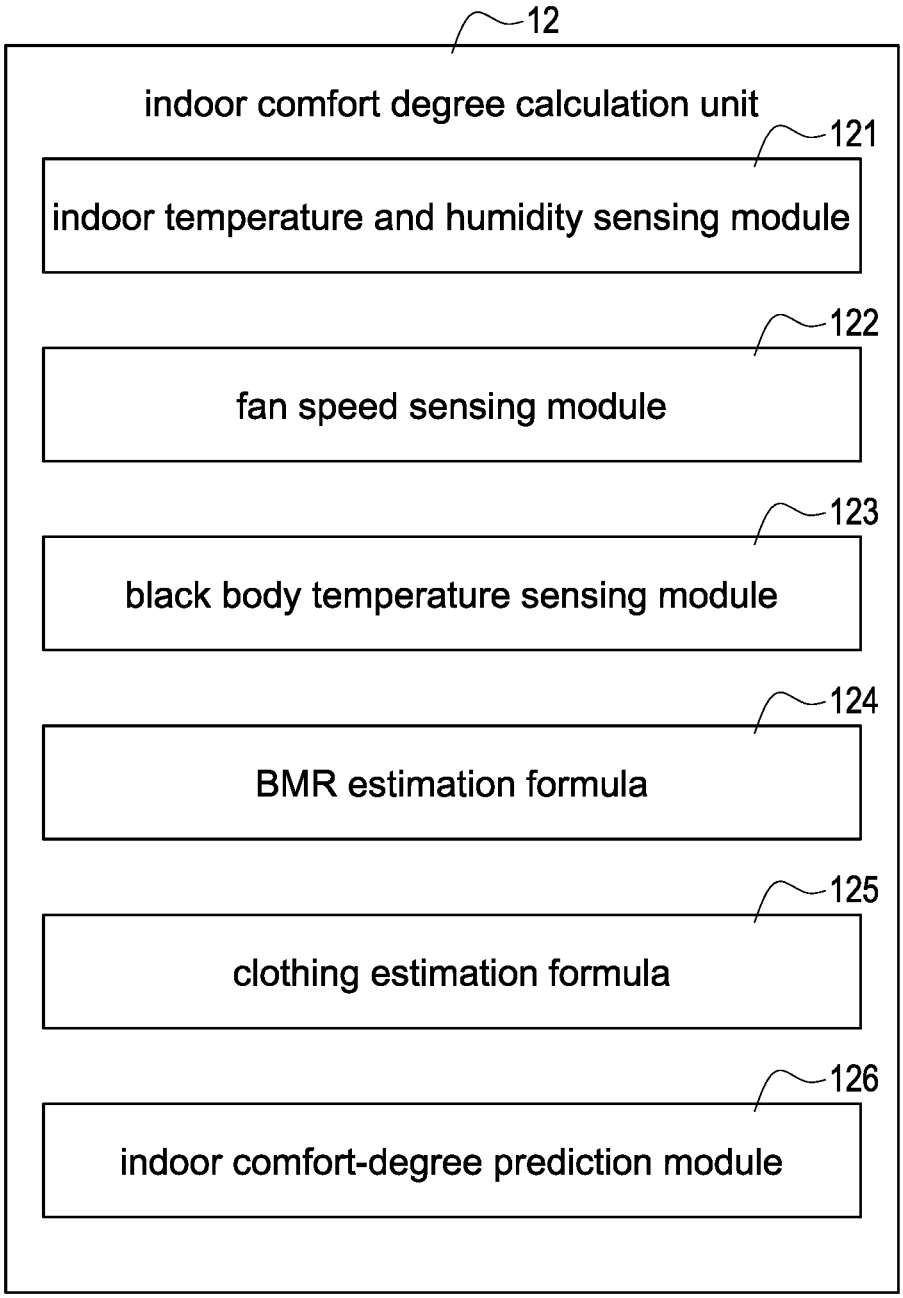
FIG. 3 is a detailed block diagram of the indoor comfort-degree calculation unit.

Referring to FIG. 3, the indoor comfort-degree calculation unit 12 of the invention is shown. In an embodiment, the indoor comfort-degree calculation unit 12 includes an indoor temperature and humidity sensing module 121, a fan speed sensing module 122 and a comfort-degree prediction module 126.

In the embodiment, the indoor temperature and humidity sensing module 121 senses temperature and humidity of a building at a first time (e.g., the current time) (hereinafter the sensed temperature and the sensed humidity respectively). Both the sensed temperature and the sensed humidity are sent to the comfort-degree prediction module 126. The fan speed sensing module 122 senses a fan speed of the air conditioning unit 15 at the first time and outputs the fan speed of the air conditioning unit 15 to the comfort-degree prediction module 126.

The comfort-degree prediction module 126 connects to the central monitoring computer 14 via the energy management unit 13 and calculates a predetermined indoor comfort-degree that the air conditioning unit 15 should reach at the second time based on the sensed temperature, the sensed humidity, and the fan speed. The comfort-degree prediction module 126 sends the predetermined indoor comfort-degree of the air conditioning unit 15 to the energy management unit 13 so that the energy management unit 13 may perform an optimum control of the air conditioning unit 15.

In another embodiment, the indoor comfort-degree calculation unit 12 further comprises a black body temperature sensing module 123. The black body sensing module 123 is provided in a building for sensing radiation temperature of the building at the first time. The black body temperature sensing module 123 sends the sensed radiation temperature to the comfort-degree prediction module 126. In the embodiment, the comfort-degree prediction module 126 calculates the predetermined indoor comfort-degree based on the sensed temperature, the sensed humidity, the fan speed of the air conditioning unit 15 and the radiation temperature. In the embodiment, radiation temperature in a building is also taken into consideration. As a result, a more accurate prediction of the indoor comfort-degree can be obtained.

In another embodiment, the indoor comfort-degree calculation unit 12 further comprises a Basal metabolic rate (BMR) estimation formula 124 and a clothing estimation formula 125 in which the BMR estimation formula 124 estimates and records BMR of a specific building (e.g., commercial office building) and the clothing estimation formula 125 estimates and records pieces of clothing (e.g., suits and dresses) of occupants of a specific building.

In the embodiment, the comfort-degree prediction module 126 reads records of the BMR estimation formula 124 and the clothing estimation formula 125 in order to obtain corresponding BMR estimation and clothing estimation. The comfort-degree prediction module 126 further calculates the indoor comfort-degree based on the sensed temperature, the sensed humidity, the fan speed, the radiation temperature, the corresponding BMR estimation and the corresponding clothing estimation. In the embodiment, both BMR estimation and clothing estimation of occupants in a building are taken into consideration. As a result, a more accurate prediction of the indoor comfort-degree can be obtained.

As described above, the indoor comfort-degree calculation unit 12 activates the comfort-degree prediction module 126 to calculate the predetermined indoor comfort-degree and sends the predetermined indoor comfort-degree to the energy management unit 13. In the embodiment, the energy management unit 13 instructs the central monitoring computer 14 to create a set temperature and a set fan speed of the air conditioning unit 15 based on the predetermined indoor comfort-degree. Specifically, the air conditioning unit 15 adjusts an operating mode based on the set temperature and the set fan speed of the air conditioning unit 15 created by the central monitoring computer 14. As an end, temperature and humidity within a building can be adjusted to the predetermined indoor comfort-degree prior to reaching the predetermined time (i.e., the second time).

In the embodiment, the set temperature is indoor temperature (e.g., 22° C. or 24° C.) that the air conditioning unit 15 is supposed to keep, and the set fan speed is a speed of a fan (e.g., low, high) of the running air conditioning unit 15. It is understood that indoor and outdoor environment factors may change from day to day. Thus, it is desired to run the air conditioning unit 15 to achieve a more comfortable interior environment. Further, load of the air conditioning unit 15 may change from time to time.

One technological characteristic of the invention is that the central monitoring computer 14 may monitor the actual load of the air conditioning unit 15 which is running at the set temperature and the set fan speed. That is, the air conditioning unit 15 runs at the set temperature and the set fan speed to achieve the predetermined indoor comfort-degree with the actual load being calculated. Also, the central monitoring computer 14 compares the predicted load with the actual load to obtain a comparison result which is used to adjust the set temperature and the set fan speed of the air conditioning unit 15 simultaneously.

Specifically, the predicted load is obtained by executing an algorithm and it represents a possible total load the air conditioning unit 15 may have in the future time period. The actual load represents the current load of the running air conditioning unit 15. The load of the air conditioning unit 15 may increase greatly if the predicted load at a future time (e.g., 3 hours from the current time) is greater than the actual load of the current time. The central monitoring computer 14 thus adjusts the operating mode of the air conditioning unit 15 based on the above procedure. In detail, load of the air conditioning unit 15 at an immediate next time period is decreased in order to decrease power consumption of the air conditioning unit 15 (i.e., saving energy). Further, the set temperature and the set fan speed of the air conditioning unit 15 are adjusted in advance, therefore, the stored chilled water of the water chiller of the air conditioning unit 15 may be prevented from being insufficient, so the water chiller may start slowly and runs at a range of 60% to 80% of the full load in order to operate efficiently.

Figure 4:
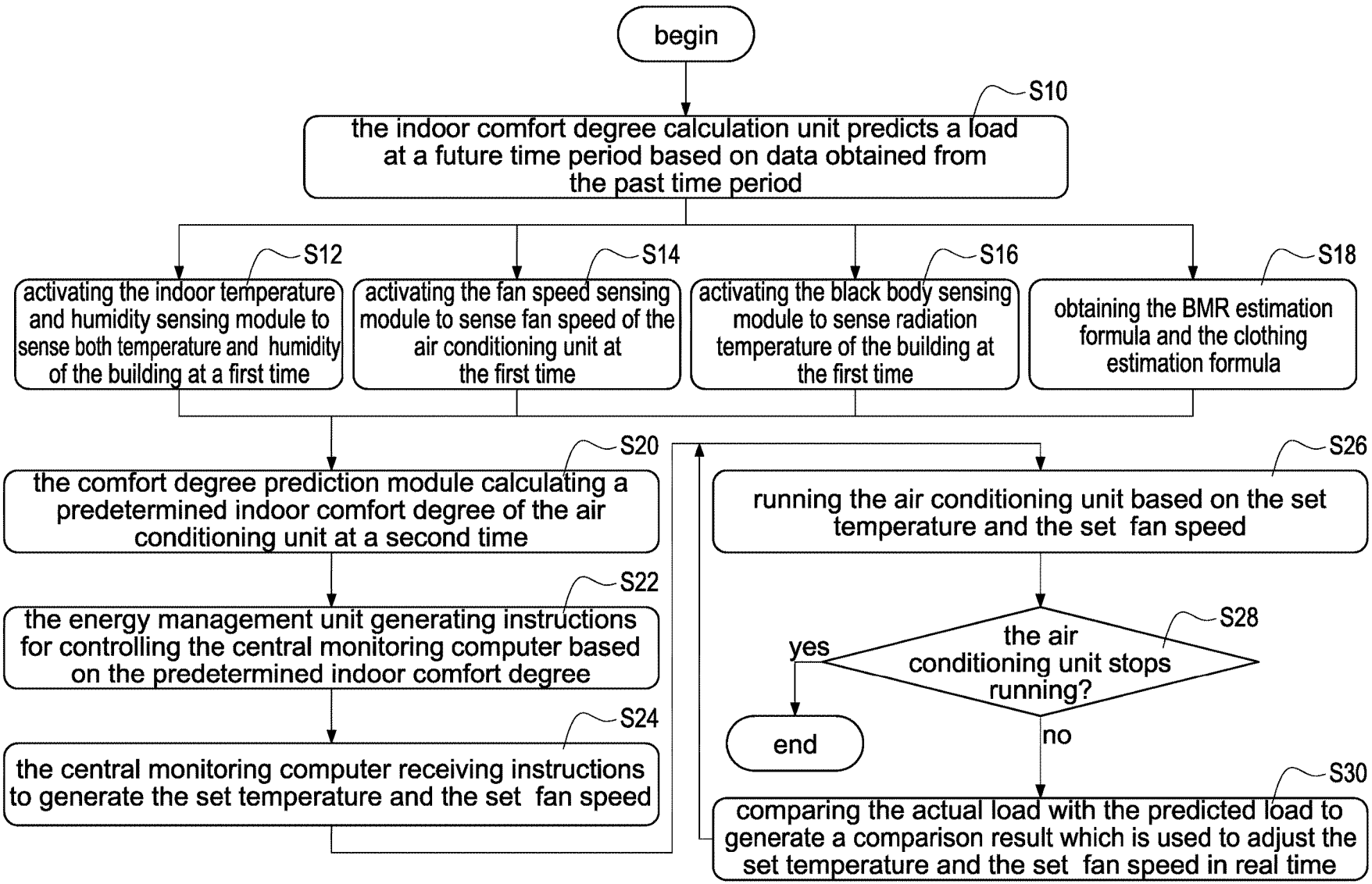
FIG. 4 is a flowchart of a method of adjusting load of air conditioning according to the invention.

Referring to FIG. 4, it illustrates a flowchart of a method of adjusting load of air conditioning according to the invention (hereinafter the adjustment method). The adjustment method carries out the adjustment system 1 of FIG. 1. Specifically, the adjustment method carries out the adjustment system 1 to control operations of the air conditioning unit 15 of a building.

As illustrated in FIG. 4, the indoor comfort-degree calculation unit 11 of the adjustment system 1 predicts a load at a future time period (e.g., office hours of tomorrow) based on data obtained from the past time period (e.g., office hours of yesterday) (step S10). As described above, the data can be schedule parameters of the air conditioning unit 15 in the past time period, indoor temperature setting conditions of the building in the past time period, exterior heat loads for the building in the past time period, and weather forecast data related to a future time period obtained in the past time period in a non-limiting manner.

Subsequently, the adjustment system 1 activates the indoor temperature and humidity sensing module 121 to sense both temperature and humidity of the building at a first time (e.g., now) (step S12), and activates the fan speed sensing module 122 to sense fan speed of the air conditioning unit 15 at the first time (step S14). Thus, the comfort-degree prediction module 126 of the adjustment system 1 can calculate a predetermined indoor comfort-degree that the air conditioning 15 has to achieved at a second time (e.g., 1 hour or 3 hours from the current time) based on the sensed temperature, the sensed humidity and fan speed of the air conditioning unit 15 (step S20). In the embodiment, the second time is later than the first time and the second time is within the future time period.

It is noted that if the adjustment system 1 has the black body temperature sensing module 123 (which is installed in a building), the adjustment system 1 may activate the black body sensing module 123 to sense radiation temperature of the building at the first time (step S16). In the embodiment, the comfort-degree prediction module 126 calculates the predetermined indoor comfort-degree based on the sensed temperature, the sensed humidity, the fan speed of the air conditioning unit 15 and the radiation temperature.

Further, the adjustment system 1 records the BMR estimation formula 124 and the clothing estimation formula 125 in, for example the indoor comfort-degree calculation unit 12 or the comfort-degree prediction module 126. The adjustment system 1 further obtains the BMR estimation formula 124 and the clothing estimation formula 125 (step S18). In the embodiment, the comfort-degree prediction module 126 calculates the predetermined indoor comfort-degree based on the sensed temperature, the sensed humidity, the fan speed of the air conditioning unit 15, the radiation temperature, the BMR estimation formula 124 and the clothing estimation formula 125.

Specifically, different buildings correspond to different BMRs. For example, BMRs are low in an office building and BMRs are high in fitness centers. Thus, a specific BMR estimation formula 124 can be found for different buildings. In an embodiment, the adjustment system 1 stores different BMR estimation formulas 124 corresponding to different buildings. In the step S18, the adjustment system 1 reads a corresponding BMR estimation formula 124 based on classification of the building in order to make the calculated indoor comfort-degree meet the actual demand.

Further, different temperatures and climates correspond to clothing estimations. For example, clothing estimations are low for summer clothing and clothing estimations are high for winter clothing. Thus, a specific clothing estimation formula 125 can be found for clothing of different seasons. In an embodiment, the adjustment system 1 stores different clothing estimation formulas 125 corresponding to different seasons. In the step S18, the adjustment system 1 reads a corresponding clothing estimation formula 125 based on outdoor temperature of the building or the current season in order to make the calculated indoor comfort-degree meet the actual demand.

Above BMR estimation formula 124 and clothing estimation formula 125 are well known in the art. Thus, a detailed description is omitted herein for the sake of brevity.

Specifically, in an embodiment, the comfort-degree prediction module 126 calculate a predetermined indoor comfort-degree of the air conditioning unit 15 based on the following formulas:

$$PMV=(0.303e^{-0.0036M}+0.028)\times(M-3.05\times10^{-3}\times(5773-6.99M-Pa)-0.42\times(M-58.15)-1.7\times10^{-5}\times M\times(5867-Pa)-0.0014\times M\times(34-Ta)-3.96\times10^{-8}\times Fcl\times((Tcl+273)^4-(Tr+273)^4)-Tcl\times Hc\times(Tcl-Ta))$$

$$Tcl=(35.7-0.275\times M+Icl\times Fcl\times(4.13\times(1+0.01(Tr-20))+Hc\times Ta))+(1+Icl\times Fcl\times(4.13\times(1+0.1Tr-20))+Hc)$$

$$Hc=12.1\times Va^{0.5}\times Va$$

$$Fcl=1+1.29\times Icl;\ \text{when } Icl<0.0078;$$

$$Fcl=1.05+0.645\times Icl;\ \text{when } Icl>0.0078;$$

$$Pa=(RH+100\times e^{(18.6686-4030.18\div(Ta+235))}\div0.00750062)$$

Where PMV is predetermined indoor comfort-degree (-), M is BMR (W/M$^2$), Ta is air temperature (° C.), Pa is vapor pressure (Pa), RH is relative humidity (%), Fcl is clothes surface coefficient (–), Id is clothes heat resistance (m$^2$×k/W), Tr is average temperature by radiation temperature (° C.), Tcl is clothes surface temperature (° C.), and Va is average wind speed.

However, above formulas are some preferred embodiments of the invention, the adjustment system 1 of the invention may execute an indoor comfort-degree formula other than above.

After step S20, the energy management unit 13 of the adjustment system 1 generates instructions for controlling the central monitoring computer 14 based on the predetermined indoor comfort-degree (step S22). Next, the central monitoring computer 14 receives the instructions to generate the set temperature and the set fan speed of the air conditioning unit 15 for adjusting an operating mode of the air conditioning unit 15 (step S24). In the invention, the adjustment system 1 calculates the predetermined indoor comfort-degree to be achieved based on the parameters of the indoor environment of a building, and further calculates required temperature and fan speed that the air conditioning unit 15 should apply for achieving the predetermined indoor comfort-degree based on the predetermined indoor comfort-degree.

After step S24, the central monitoring computer 14 connects to the air conditioning unit 15 by wire or wirelessly and activates the air conditioning unit 15 based on the set temperature and the set fan speed (step S26). In the embodiment, the predetermined indoor comfort-degree can be achieved at the second time if the air conditioning unit 15 operates based on the set temperature and the set fan speed.

In the invention, the adjustment system 1 continuously monitors the running air conditioning unit 15 using the central monitoring computer 14 in order to determine whether the air conditioning unit 15 operates or not (step S28). If the air conditioning unit 15 operates normally, the central monitoring computer 14 monitors the air conditioning unit 15, calculates the actual load of the air conditioning unit 15, compares the actual load with the predicted load to generate a comparison result, and uses the comparison result to adjust the set temperature and the set fan speed of the air conditioning unit 15 simultaneously (step S30). The method returns to step S26 prior to stopping operation of the air conditioning unit 15 so that the air conditioning unit 15 may operate at the adjusted set temperature and the adjusted fan speed as controlled by the central monitoring computer 14.

As described above, the primary object of the invention is to decrease load of the air conditioning unit 15 in advance in next period of time (e.g., increase the predetermined indoor comfort-degree to be achieved) after predicting that the load of the air conditioning unit 15 will be increased greatly. As such, the purposes of saving energy and decreasing power consumption at peak time can be obtained. Further, it is possible of increasing load of the air conditioning unit 15 in advance in next period of time (e.g., decrease the predetermined indoor comfort-degree to be achieved) after predicting that the load of the air conditioning unit 15 will be decreased greatly. As such, the purpose of improving the comfort of occupants of a building can be obtained in consideration of sufficient power supply or stored chilled water. Further, the air conditioning unit 15 and/or the water chiller may operate at an optimum operating state of 60% to 80% of its full load.

Figure 5:
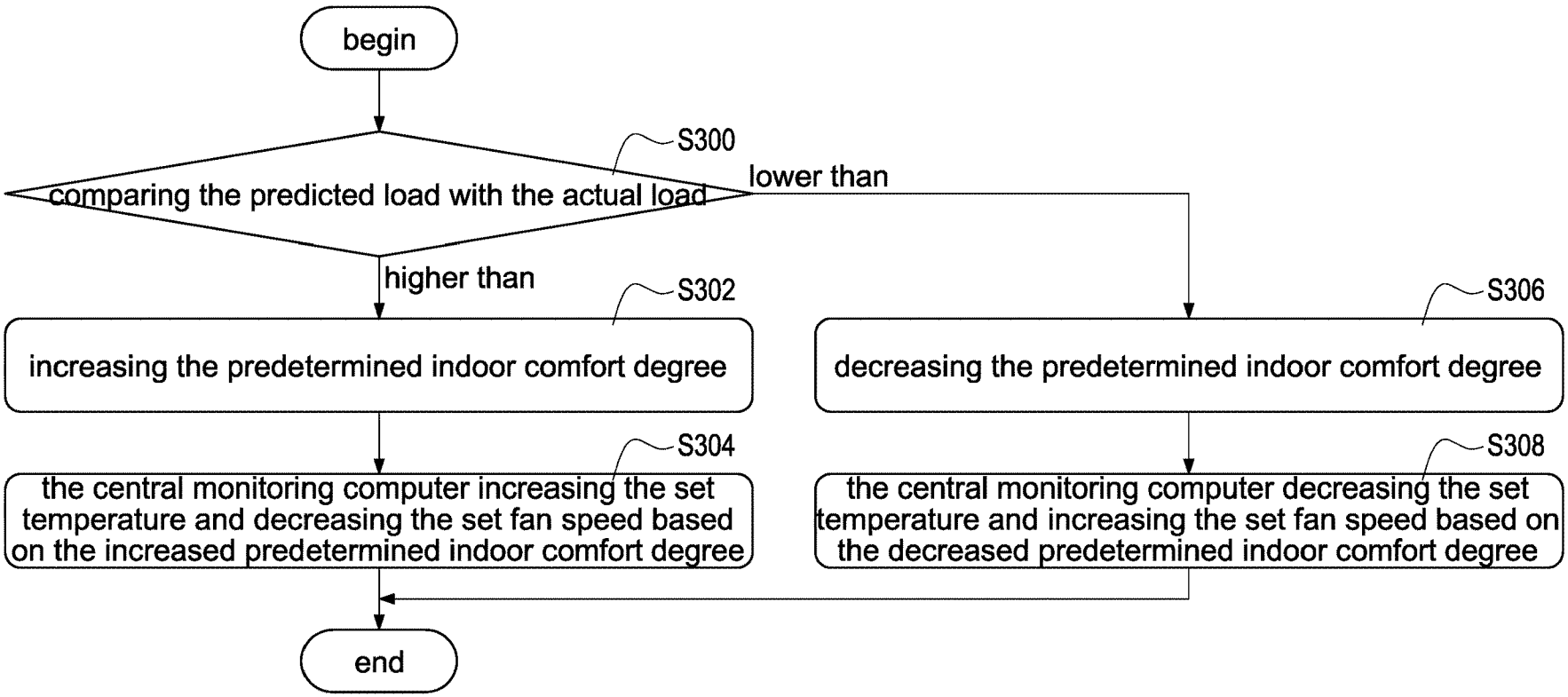
FIG. 5 is a flowchart of the air conditioning unit according to a first preferred embodiment of the invention for further illustrating step S30 of FIG. 4.

Referring to FIG. 5, it is a flowchart of the air conditioning unit 15 according to a first preferred embodiment of the invention for further illustrating step S30 of FIG. 4 by discussing the central monitoring computer 14 how to adjust operation of the air conditioning unit 15 in real time.

As illustrated in FIG. 5, in a normal operation of the air conditioning unit 15, the central monitoring computer 14 continuously monitors the air conditioning unit 15, calculates the actual load of the air conditioning unit 15, and compares the predicted load with the actual load (step S300). Specifically, in step S300, the central monitoring computer 14 compares the current load (i.e., actual load) of the air conditioning unit 15 with a load (i.e., predicted load) of the air conditioning unit 15 in a future-period of time (e.g., 3 hours from the current time).

After the comparison of the step S300, the central monitoring computer 14 can predict whether the air conditioning unit 15 has a significant load change in a future-period of time. For example, the central monitoring computer 14 compares the actual load of the current time (e.g., 12 AM noon) with a predicted load of a specific time (e.g., 3 PM afternoon). In view of the comparison, it is found that the air conditioning unit 15 may have a great load increase because, for example, a meeting involved many people will take place in a building. Thus, the central monitoring computer 14 may adjust the operation of the air conditioning unit 15 in advance in order to achieve a more comfortable interior environment for the participant of the meeting to be held. Otherwise, the participant of the meeting to be held will feel very uncomfortable after entering the building. Further, the purpose of saving energy can be achieved.

After step S300, in response to a determination of the predicted load at a specific future time greater than the actual load at the current time, the central monitoring computer 14 increases the predetermined indoor comfort-degree that the air conditioning unit 15 required to reach at the second time (step S302). Further, the central monitoring computer 14 adjusts the set temperature and the set fan speed of the air conditioning unit 15 based on the adjusted indoor comfort-degree. In the embodiment, the central monitoring computer 14 increases the set temperature and decreases the set fan speed based on the increased predetermined indoor comfort-degree by (step S304).

It is noted that the predetermined indoor comfort-degree of the invention is obtained from a predicted mean vote (PMV) well known in air conditioning. The interior environment is acceptable if the predetermined indoor comfort-degree is 0. The higher of the predetermined indoor comfort-degree (e.g., +1, +2, +3, etc.) the hotter of the interior environment is and the lower of the predetermined indoor comfort-degree (e.g., −1, −2, −3, etc.) the cooler of the interior environment is. Typically, optimum indoor comfort-degree is in the range of −0.5 to +0.5.

In view of the above description, the interior environment becomes uncomfortable and hot when the central monitoring computer 14 increases the predetermined indoor comfort-degree, resulting in a decrease of the load of the air conditioning unit 15. To the contrary, the interior environment becomes comfortable and cool when the central monitoring computer 14 decreases the predetermined indoor comfort-degree, resulting in an increase of the load of the air conditioning unit 15.

In response to determining the predicted load is less than the actual load by the central monitoring computer 14 in step S300, i.e., meaning the air conditioning unit 15 being allowed to increase load at a future time period (e.g., 1 to 3 hours from the current time), the predetermined indoor comfort-degree that the air conditioning unit 15 required to reach at the second time can be decreased in advanced (step S306).

After step S306, the central monitoring computer 14 adjusts the set temperature and the set fan speed of the air conditioning unit 15 based on the decreased predetermined indoor comfort-degree. In the embodiment, the central monitoring computer 14 decreases the set temperature and increases the set fan speed to decrease the predetermined indoor comfort-degree, i.e., improving the comfort-degree of the indoor environment (step S308).

It is noted that it is possible of quickly changing interior environment by adjusting the set temperature of the air conditioning unit 15 but it is only possible of slowly changing interior environment by adjusting the set fan speed of the air conditioning unit 15. Thus, in step S308, the central monitoring computer 14 adds weights to the set temperature and the set fan speed respectively. If the weight of the set temperature is greater than that of the set fan speed, after step S308, the interior environment can be quickly adjusted for improvement at the expense of greatly increased load of the air conditioning unit 15. To the contrary, if the weight of the set temperature is less than that of the set fan speed, after step S308, the interior environment can only be slowly adjusted for improvement at the expense of slightly increased load of the air conditioning unit 15. In other words, a user may adjust the weights based on purposes.

By taking advantages of above technological characteristics, it is envisaged by the invention that it is possible of predicting load of the air conditioning unit 15 in a future-period of time and in turn adjusting the comfort-degree to be achieved by the air conditioning unit 15 now. As a result, purposes of energy saving and decreasing power consumption at peak time can be obtained.

Specifically, the central monitoring computer 14 adjusts the set temperature and the set fan speed of the air conditioning unit 15 in advance based on the predetermined indoor comfort-degree, thereby preventing occupants from suffering discomfort due to quick operation adjustment of the air conditioning unit 15 in response to quick interior environment change. Further, the water chiller of the air conditioning unit 15 may slowly make adjustments to keep at an optimum operating state which is 60% to 80% of its full load by adjusting temperature and fan speed in advance. As a result, the purpose of saving energy is obtained.

Figure 6:
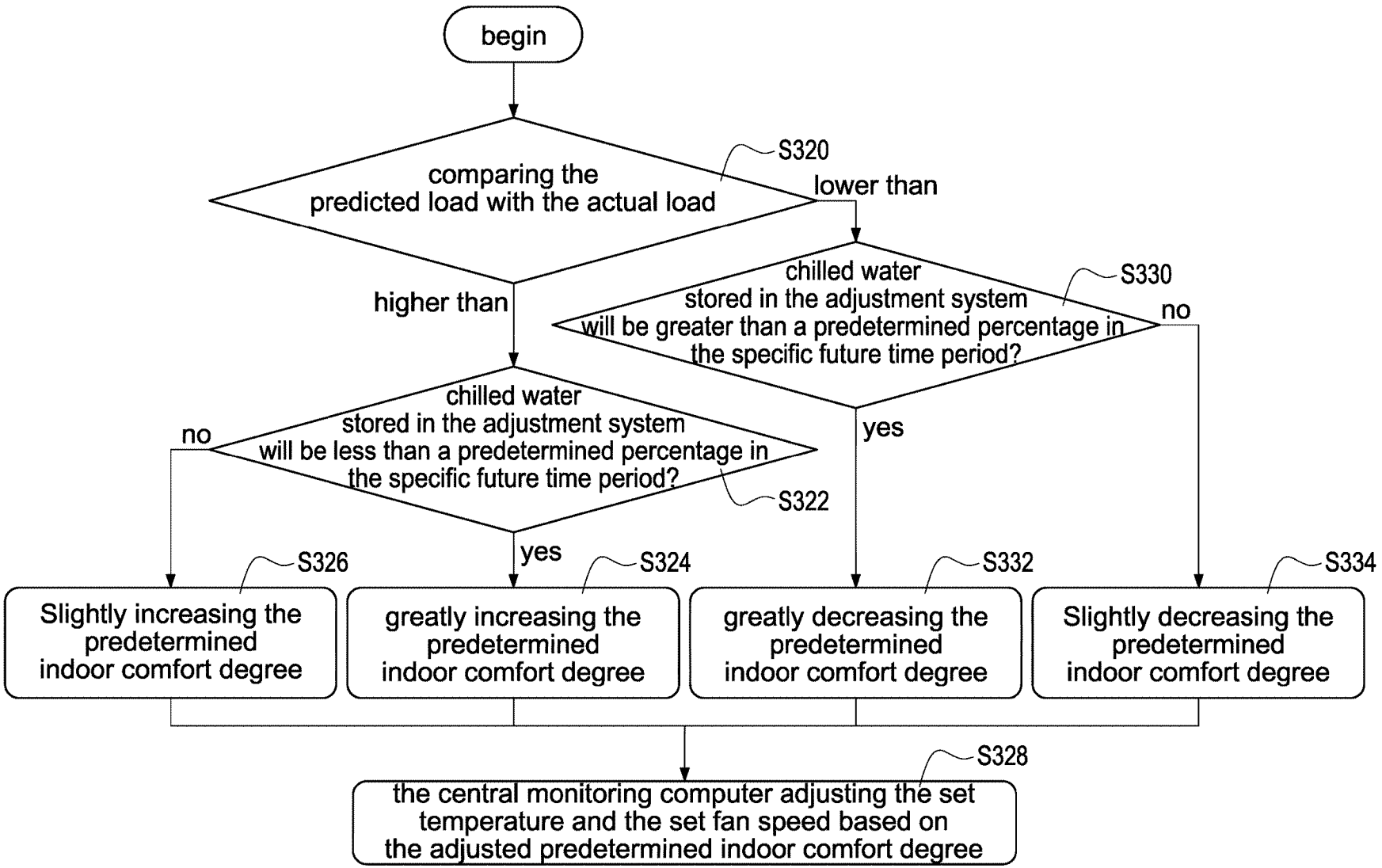
FIG. 6 is a flowchart of the air conditioning unit according to a second preferred embodiment of the invention for further illustrating step S30 of FIG. 4.

Referring to FIG. 6, it is a flowchart of the air conditioning unit 15 according to a second preferred embodiment of the invention for further illustrating step S30 of FIG. 4.

As illustrated in FIG. 6, the central monitoring computer 14 monitors an actual load of the air conditioning unit 15 using a sensor or by performing a calculation based on the current set temperature and the current set fan speed. The central monitoring computer 14 further compares the predicted load with the actual load (step S320).

As described above, it is envisaged by the invention that the predicted load is obtained by predicting the load that the air conditioning unit 15 may require at a future time period. In step S320, the central monitoring computer 14 compares the predicted load of the air conditioning unit 15 at a specific future time period (e.g., 3 hours from the current time) with the actual load of the air conditioning unit 15 at the current time.

In step S320, if the central monitoring computer 14 determines that the predicted load of the specific future time period is greater than the actual load, the central monitoring computer 14 further determines whether the chilled water stored in the water chiller of the adjustment system 1 will be less than a predetermined percentage at the specific future time period (step S322). For example, the central monitoring computer 14 further determines whether the chilled water stored in the water chiller of the adjustment system 1 will be less than 30% of the expected chilled water storage in next 3 hours.

If the determination in step S322 is yes, it means that the air conditioning unit 15 will meet a great load change in an immediate future. In response, the central monitoring computer 14 greatly increases the predetermined indoor comfort-degree that the air conditioning unit 15 is required to achieve at the second time (step S324). To the contrary, if the determination in step S322 is no, it means that the air conditioning unit 15 will only meet a small load change in an immediate future. In response, the central monitoring computer 14 only slightly increases the predetermined indoor comfort-degree that the air conditioning unit 15 is required to achieve at the second time (step S326).

In an embodiment, in the step S324 the central monitoring computer 14 increases the predetermined indoor comfort-degree by one and in the step S326 the central monitoring computer 14 increases the predetermined indoor comfort-degree by 0.5 in a non-limiting manner.

Further, in step S320 if the central monitoring computer 14 determines that the predicted load of the specific future time period is less than the actual load, the central monitoring computer 14 determines whether the chilled water stored in the water chiller of the adjustment system 1 will be greater than a predetermined percentage at the specific future time period (step S330). For example, the central monitoring computer 14 determines whether the chilled water stored in the water chiller of the adjustment system 1 will be greater than 30% of the expected chilled water storage in next 3 hours.

If the determination in step S330 is yes, it means that the air conditioning unit 15 will meet a great load decrease in an immediate future (i.e., a great decrease of power consumption). In response, the central monitoring computer 14 greatly decreases the predetermined indoor comfort-degree that the air conditioning unit 15 is required to achieve at the second time (step S332). To the contrary, if the determination in step S330 is no, it means that the air conditioning unit 15 will only meet a small load decrease in an immediate future. In response, the central monitoring computer 14 only slightly decreases the predetermined indoor comfort-degree that the air conditioning unit 15 is required to achieve at the second time (step S334).

In an embodiment, in the step S332 the central monitoring computer 14 decreases the predetermined indoor comfort-degree by one and in the step S334 the central monitoring computer 14 decreases the predetermined indoor comfort-degree by 0.5 in a non-limiting manner.

After steps S324, S326 and S332 or S334, the central monitoring computer 14 adjusts the set temperature and the set fan speed based on the adjusted predetermined indoor comfort-degree (step S328). Specifically, the central monitoring computer 14 increases the set temperature and decreases the set fan speed based on the predetermined indoor comfort-degree increased at step S324 or S326. Further, the central monitoring computer 14 decreases the set temperature and increases the set fan speed based on the predetermined indoor comfort-degree decreased at step S332 or S334.

By taking advantages of above technological characteristics, it is envisaged by the invention that it is possible of decreasing power consumption at peak time (e.g., office hours) of the air conditioning unit 15, thereby obtaining the purposes of saving energy and optimizing the control.

Figure 7:
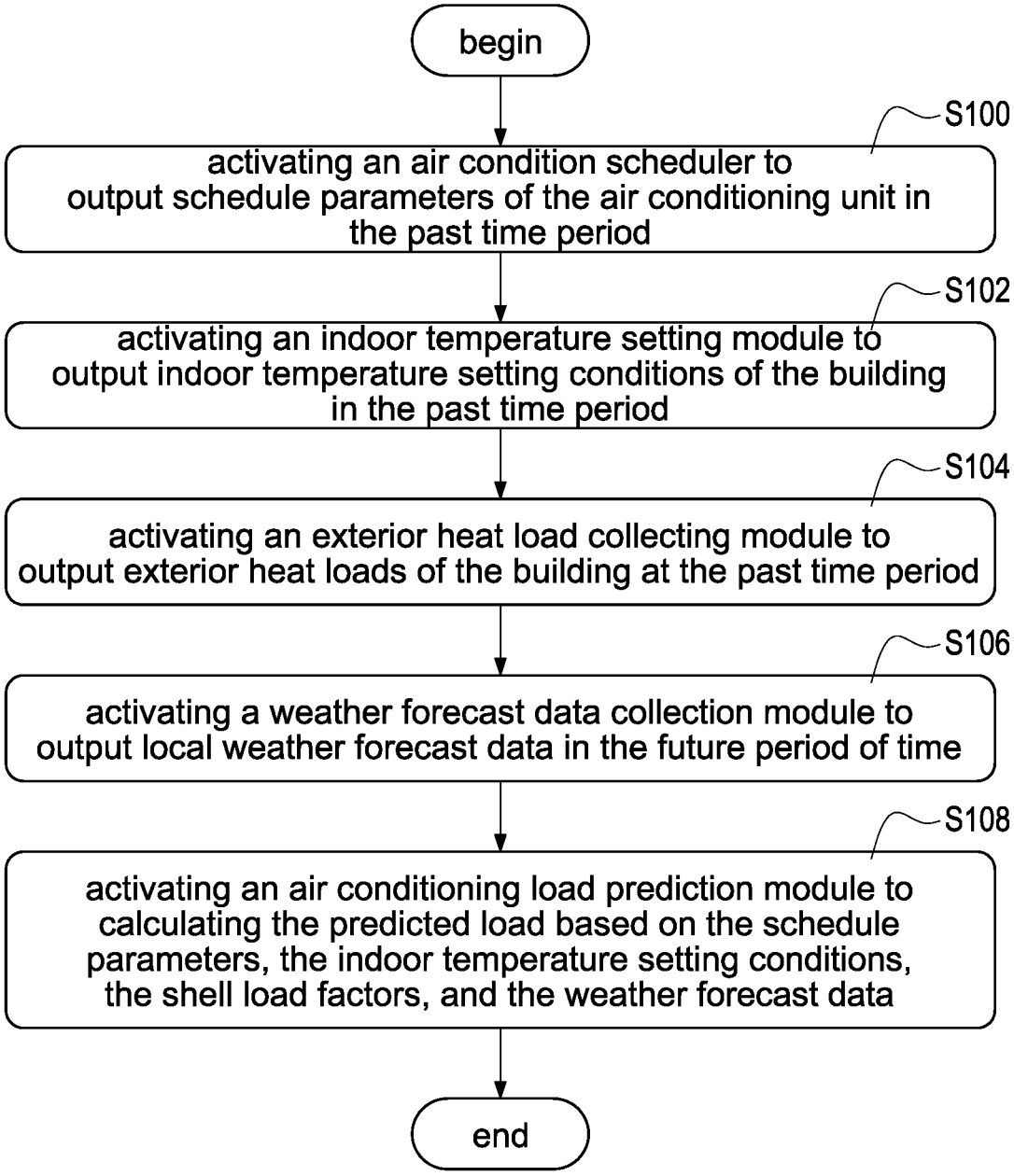
FIG. 7 is a flowchart of calculating the predicted load according to a first preferred embodiment of the invention.

Referring FIG. 7, it is a flowchart of calculating the predicted load according to a first preferred embodiment of the invention for further illustrating the adjustment system 1 of the invention how to activate the air conditioning load prediction unit 11 to calculate a predicted load that the air conditioning unit 15 may have at a future time period.

As illustrated in FIG. 7, prior to activating the air conditioning unit 15, the air conditioning load prediction unit 11 of the adjustment system 1 activates the air-condition scheduler 111 to obtain schedule parameters of the air conditioning unit 15 at a past time period (e.g., office hours of yesterday) (step S100). For example, the air conditioning unit 15 includes at least one fan control unit (FCU) and at least one heat recovery ventilation (HRV) in a building. In the embodiment, the schedule parameters are time schedule parameters including starting time, fan speed and stop time parameters of the FCU and the HRV in the past time period.

The air conditioning load prediction unit 11 activates the indoor temperature setting module 112 to calculate indoor temperature setting conditions of a building in the past time period (step S102). Specifically, the indoor temperature setting module 112 calculates indoor temperature setting conditions of a building based on both indoor temperature and outdoor temperature at a past time period. In an embodiment, a formula of indoor temperature setting conditions is $$T_{set}=0.48T_{in}+0.14T_{out}+8.22$$

where $T_{set}$ is temperature setting conditions, $T_{in}$ is indoor temperature of a building in the past time period, and $T_{out}$ is outdoor temperature of the building in the past time period.

The air conditioning load prediction unit 11 further activates the exterior heat load collecting module 113 to calculate exterior heat loads for the building in the past time period (step S104). For example, the exterior heat load collecting module 113 executes an E22 energy simulation software to calculate exterior heat loads for the building in the past time period. The E22 energy simulation software is freeware so that a detailed description thereof omitted herein for the sake of brevity.

Specifically, the exterior heat load collecting module 113 imports data including materials of exterior wall of the building, landmark of the building, etc. to the E22 energy simulation software and executes the E22 energy simulation software to create information of exterior wall of the building. Next, the exterior heat load collecting module 113 imports data about local weather, windows opening frequency of the building in the past time period, windows shading factors of the building in the past time period, orientation of the building, etc. to the E22 energy simulation software and executes the E22 energy simulation software to calculate the exterior heat loads for the building.

The air conditioning load prediction unit 11 further activates the weather forecast data collection module 114 to obtain local weather forecast data of the building at a future time period (e.g., office hours of tomorrow) (step S106). In the embodiment, the local weather forecast data is, for example hourly outdoor temperature and relative humidity of the building in the future time period.

It is noted that steps S100 to S106 are not required to perform sequentially. The air conditioning load prediction unit 11 may obtain above data simultaneously or in any desired order not limited by that illustrated in FIG. 7.

After obtaining above data including schedule parameters, indoor temperature setting conditions, exterior heat loads for the building and local weather forecast data, the air conditioning load prediction module 115 calculates a predicted load that the air conditioning unit may have in the future time period and creates same based on the data including schedule parameters, indoor temperature setting conditions, exterior heat loads for the building and local weather forecast data.

Figure 8:
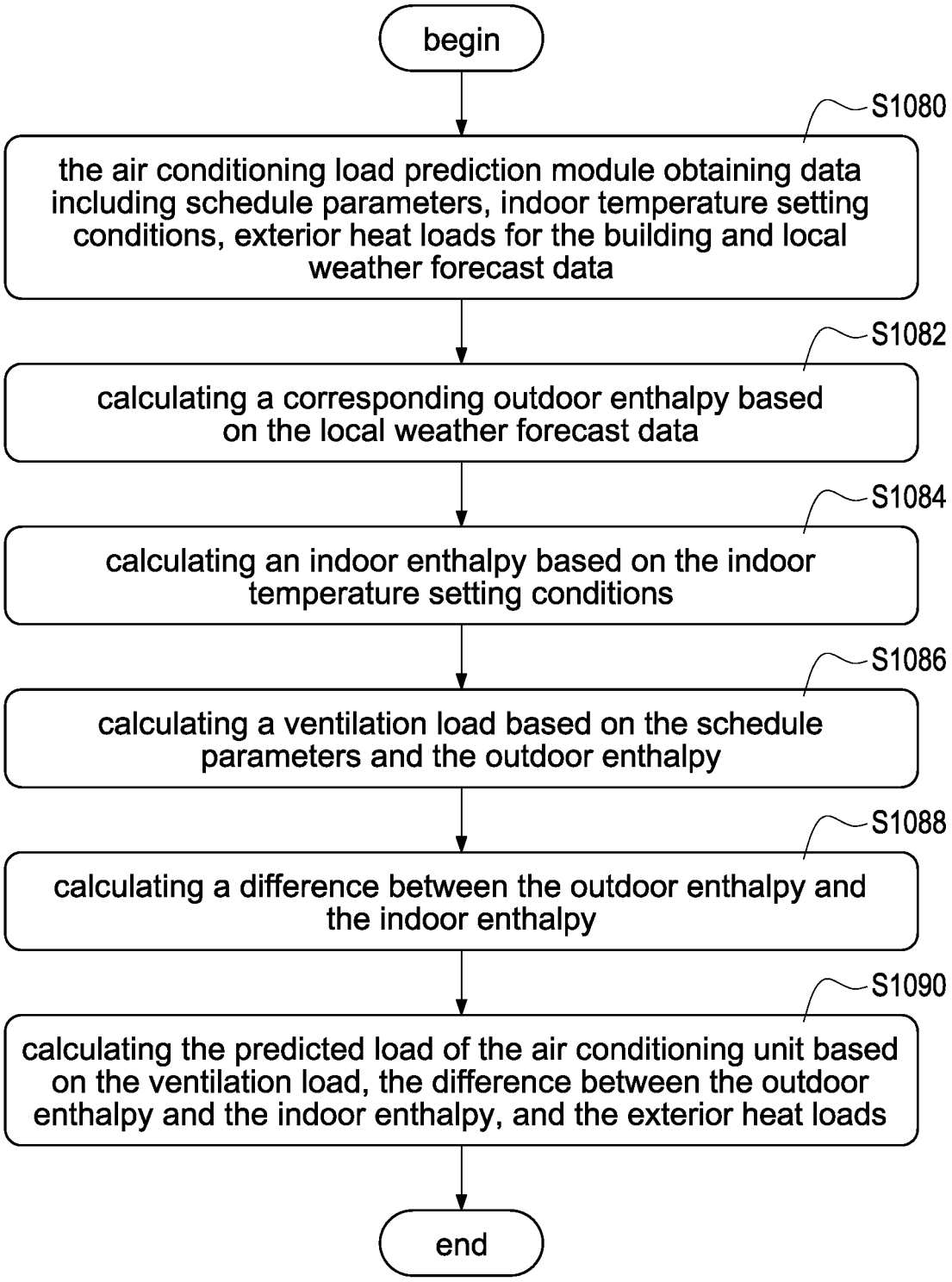
FIG. 8 is a flowchart of calculating the predicted load according to a second preferred embodiment of the invention.

Referring FIG. 8, it is a flowchart of calculating the predicted load according to a second preferred embodiment of the invention for further illustrating details of step S108 of FIG. 7 and the air conditioning load prediction module 115 of the invention how to calculate a predicted load that the air conditioning unit 15 may have at a future time period.

As illustrated in FIG. 8, the air conditioning load prediction module 115 obtains above data including schedule parameters, indoor temperature setting conditions, exterior heat loads for the building and local weather forecast data (step S1080), and the air conditioning load prediction module 115 performs a corresponding prediction procedure based on the data.

In the embodiment, the air conditioning load prediction module 115 calculates a corresponding outdoor enthalpy based on the local weather forecast data (step S1082).

In step S1082, the air conditioning load prediction module 115 first calculates an atmospheric pressure at a future time period based on the following formula 1:

$$P_S=(6.1164*10^{(7.591386*T/(T+240.7263))})/10$$

In the formula 1, $P_S$ is a predicted value of the atmospheric pressure in the future time period, and T is hourly outdoor temperature shown in the local weather forecast data.

The air conditioning load prediction module 115 further calculates a specific humidity ratio at the future time period based on the following formula 2:

$$\omega=(0.6219*P_S*RH/100)/(101.325-(P_S*RH/100))$$

In the formula 2, ω is a predicted value of the specific humidity ratio at the future time period and RH is relative humidity shown in the local weather forecast data.

The air conditioning load prediction module 115 further calculates the outdoor enthalpy at the future time period based on the following formula 3:

$$H_{oa}=T*(1.01+1.89*W)+2500*\omega$$

In the formula 3, $H_{oa}$ is a predicted value of the outdoor enthalpy (kJ/kg) at the future time period.

In the embodiment, the air conditioning load prediction module 115 calculates an atmospheric pressure at a future time period based on an hourly outdoor temperature shown in the local weather forecast data. Next, the air conditioning load prediction module 115 calculates a specific humidity ratio at the future time period based on the atmospheric pressure and the relative humidity shown in the local weather forecast data. Finally, the air conditioning load prediction module 115 calculates an outdoor enthalpy at the future time period based on the specific humidity ratio and the hourly outdoor temperature shown in the local weather forecast data.

After step S1082, the air conditioning load prediction module 115 calculates an indoor enthalpy of a building at a past time period based on the indoor temperature setting conditions (step S1084). In the embodiment, the air conditioning load prediction module 115 first calculates an atmospheric pressure in the past time period based on the following formula 4:

$$P_S=(6.1164*10^{(7.591386*T/(T+240.7263))})/10$$

In the formula 4, $P_S$ is the atmospheric pressure in the past time period and T is the indoor temperature setting conditions.

The air conditioning load prediction module 115 then calculates a specific humidity ratio at the past time period based on the following formula 5:

$$\omega=(0.6219*P_S*65/100)/(101.325(P_S*65/100))$$

In the formula 5, co is the specific humidity ratio in the past time period.

The air conditioning load prediction module 115 further calculates an indoor enthalpy at the past time period based on the following formula 6:

$$H_{indoor}\ T*(1.01+1.89*W)+2500*\omega$$

In the formula 6, $H_{indoor}$ is the indoor enthalpy in the past time period. In the embodiment, the air conditioning load prediction module 115 calculates an atmospheric pressure at a past time period based on the indoor temperature setting conditions. Further, the air conditioning load prediction module 115 calculates a specific humidity ratio in the past time period based on the atmospheric pressure in the past time period and a predetermined humidity. Finally, the air conditioning load prediction module 115 calculates an indoor enthalpy based on the specific humidity ratio and the indoor temperature setting conditions.

After step S1084, the air conditioning load prediction module 115 calculates a ventilation load based on the schedule parameters and the outdoor enthalpy (step S1086). The ventilation load means increased heat of a building due to circulation of air (e.g., introducing fresh air into the building). In other words, the step S1086 is to predict possible actions with respect to the building in the future time period, and calculates the heat of the building that may increase due to execution of the possible actions. The increased heat may be use to represent the increased load of the air conditioning unit 15 in the future time period.

Specifically, the air conditioning load prediction module 115 calculates the ventilation load based on the following formula 7:

$$\eta*\rho*m*(H_{oa}-40.13)/3600*T_{open}$$

In the formula 7, η is equipment efficiency (%) of the air conditioning unit 15, ρ is air density (kg/m$^3$), m is cubic meter per hour (CMH), $H_{oa}$ is the outdoor enthalpy, and $T_{open}$ is the schedule parameter of the air conditioning unit 15. It is noted that 11 can be the standard equipment efficiency labeled on the housing of the air conditioning unit 15, and p is standard air density, i.e., 1.2 kg/m$^3$ but in a non-limiting manner.

After step S1086, the air conditioning load prediction module 115 calculates a difference between the outdoor enthalpy and the indoor enthalpy (step S1088). Specifically, the air conditioning load prediction module 115 calculates the difference between the outdoor enthalpy and the indoor enthalpy based on the following formula 8:

$$H_{oa}-H_{indoor}$$

Next, the air conditioning load prediction module 115 calculates the predicted load that the air conditioning unit 15 may have at the future time period based on the ventilation load, the difference between the outdoor enthalpy and the indoor enthalpy, and the exterior heat loads for the building (step S1090).

In the embodiment, air conditioning load prediction module 115 calculates the predicted load based on the ventilation load, the difference between the outdoor enthalpy and the indoor enthalpy, and the exterior heat loads representing different orientations (e.g., east, west, south and north) of the building. Thus, the invention can solve problem of incorrect prediction experienced by the conventional air conditioning system which only takes sensible heat into consideration.

The adjustment system 1 of the invention predicts a possible load of the air conditioning unit 15 at a future time period (e.g., tomorrow) based on collected data at a past time period (e.g., yesterday). Further, the adjustment system 1 of the invention compares the actual load with the predicted load hourly and obtains a comparison result which is used to adjust both the set temperature and the set fan speed of the air conditioning unit 15 in real time. Therefore, an optimum control of the air conditioning unit 15 is carried out, energy is saved, and power consumption at peak time is decreased.

While the invention has been described in terms of preferred embodiments, those skilled in the art will recognize that the invention can be practiced with modifications within the spirit and scope of the appended claims.

What is claimed is:

1. A system of adjusting load of air conditioning of a building, comprising:

a central monitoring computer;

a first controller;

a second controller connected to the central monitoring computer via the first controller, configured to predict a load of an air conditioning unit at a future time period based on data obtained from a past time period, and send the predicted load to the first controller;

a first sensor configured to sense both a temperature and a humidity of a building at a first time, and output both the sensed temperature and the sensed humidity;

a second sensor configured to sense a fan speed of the air conditioning unit at the first time, and output the sensed fan speed; and a third controller embedded with an algorithm connected to the central monitoring computer via the first controller, configured to calculate a predetermined indoor comfort-degree that the air conditioning unit is required to reach at a second time based on the sensed temperature, the sensed humidity, and the sensed fan speed, and send the predetermined indoor comfort-degree to the first controller, wherein the second time is later than the first time and the second time is within the future time period;

wherein the first controller instructs the central monitoring computer to set both a temperature and a fan speed of the air conditioning unit based on the predetermined indoor comfort-degree; and wherein in response to the air conditioning unit running at the set temperature and the set fan speed, the central monitoring computer compares the predicted load with an actual load of the air conditioning unit to obtain a comparison result, and the central monitoring computer adjusts the set temperature and the set fan speed of the air conditioning unit in real time in response to the obtained comparison result.

2. The system as claimed in claim 1, further comprising a third sensor configured to sense and output radiation temperature of the building at the first time, wherein the third controller calculates the predetermined indoor comfort-degree based on the sensed temperature, the sensed humidity, the sensed fan speed, and the radiation temperature.

3. The system as claimed in claim 2, wherein the third controller includes a Basal metabolic rate (BMR) estimation formula and a clothing estimation formula, and the indoor comfort-degree calculation unit calculates the predetermined indoor comfort-degree based on the sensed temperature, the sensed humidity, the sensed fan speed, the radiation temperature, the BMR estimation formula, and the clothing estimation formula.

4. The system as claimed in claim 3, wherein the BMR estimation formula estimates and records BMR of a typical occupant of the building, and the third controller reads records of the BMR estimation formula based on a classification of the building to obtain corresponding BMR estimation.

5. The system as claimed in claim 3, wherein the clothing estimation formula estimates and records predetermined pieces of clothing of occupants of the building, and the third controller reads records of the clothing estimation formula based on an outdoor temperature or a current season to obtain corresponding clothing estimation.

6. The system as claimed in claim 3, wherein in response to the predicted load at the future-period of time being greater than the actual load, the first controller increases the predetermined indoor comfort-degree that the air conditioning unit is required to reach at the second time, and the central monitoring computer increases the set temperature and decreases the set fan speed based on the increased predetermined indoor comfort-degree.

7. The system as claimed in claim 3, wherein in response to the predicted load at the future-period of time being less than the actual load, the first controller decreases the predetermined indoor comfort-degree that the air conditioning unit is required to reach at the second time, and the central monitoring computer decreases the set temperature and increases the set fan speed based on the decreased predetermined indoor comfort-degree.

8. The system as claimed in claim 3, wherein the second controller includes:

a second data collector configured for outputting schedule parameters of the air conditioning unit in the past time period;

a first data collector configured for outputting indoor temperature setting conditions of the building in the past time period;

an energy simulation software configured for outputting exterior heat loads for the building in the past time period;

a third data collector configured for outputting weather forecast data in the future time period, wherein the weather forecast data includes an outdoor temperature and a relative humidity in the future time period; and an air conditioning load prediction calculator for calculating the predicted load based on the schedule parameters, the indoor temperature setting conditions, the exterior heat loads, and the weather forecast data.

9. The system as claimed in claim 8, wherein the energy simulation software calculates the exterior heat loads based on data including windows opening frequency of the building in the past time period, windows shading factors of the building in the past time period which describe how much sunlight the windows of the building receive during the past time period, and at least one orientation of the building.

10. The system as claimed in claim 8, wherein the air conditioning load prediction calculator calculates:

a corresponding outdoor enthalpy based on the weather forecast data;

an indoor enthalpy based on the indoor temperature setting conditions;

a difference between the outdoor enthalpy and the indoor enthalpy;

a ventilation load based on the schedule parameters and the outdoor enthalpy; and the predicted load based on the ventilation load, the difference between the outdoor enthalpy and the indoor enthalpy, and the exterior heat loads.

11. A method of adjusting load of air conditioning of a building by controlling an air conditioning unit of the building, comprising following steps of:

a) activating a second controller to predict a load of the air conditioning unit at a future time period based on data obtained from a past time period;

b) activating a first sensor to sense both a temperature and a humidity of the building at a first time;

c) activating a second sensor to sense a fan speed of the air conditioning unit at the first time;

d) activating a third controller embedded with an algorithm to calculate a predetermined indoor comfort-degree that the air conditioning unit is required to reach at a second time based on the sensed temperature, the sensed humidity, and the sensed fan speed, wherein the second time is later than the first time and the second time is within the future time period;

e) activating a first controller to instruct a central monitoring computer to set both a temperature and a fan speed of the air conditioning unit based on the predetermined indoor comfort-degree;

f) controlling the air conditioning unit to run at the set temperature and the set fan speed; and g) instructing the central monitoring computer to compare the predicted load with an actual load of the air conditioning unit to obtain a comparison result, and to adjust the set temperature and the set fan speed of the air conditioning unit in real time in response to the obtained comparison result.

12. The method as claimed in claim 11, wherein before step d) further comprises a sub-step d1) of activating a third sensor to sense radiation temperature of the building at the first time, and wherein in step d) the third controller calculates the predetermined indoor comfort-degree based on the sensed temperature, the sensed humidity, the sensed fan speed, and the radiation temperature.

13. The method as claimed in claim 12, wherein before step d) further comprises a sub-step d2) of obtaining a Basal metabolic rate (BMR) estimation formula and a clothing estimation formula, wherein in step d) the third controller calculates the predetermined indoor comfort-degree based on the sensed temperature, the sensed humidity, the sensed fan speed, the radiation temperature, the BMR estimation formula, and the clothing estimation formula.

14. The method as claimed in claim 13, wherein the BMR estimation formula estimates and records BMR of a typical occupant of the building, and wherein in step d2) the third controller reads records of the BMR estimation formula based on a classification of the building to obtain corresponding BMR estimation.

15. The method as claimed in claim 13, wherein the clothing estimation formula estimates and records predetermined pieces of clothing of occupants of the building, and wherein in step d2) the third controller reads records of the clothing estimation formula based on an outdoor temperature or a current season to obtain corresponding clothing estimation.

16. The method as claimed in claim 13, wherein step g) comprises following sub-steps of:

g11) in response to the predicted load at the future-period of time being greater than the actual load, instructing the first controller to increase the predetermined indoor comfort-degree that the air conditioning unit is required to reach at the second time; and g12) instructing the central monitoring computer to increase the set temperature and decrease the set fan speed based on the increased predetermined indoor comfort-degree.

17. The method as claimed in claim 13, wherein step g) comprises following sub-steps of:

g21) in response to the predicted load at the future-period of time being less than the actual load, instructing the first controller to decrease the predetermined indoor comfort-degree that the air conditioning unit is required to reach at the second time; and g22) instructing the central monitoring computer to decrease the set temperature and increase the set fan speed based on the decreased predetermined indoor comfort-degree.

18. The method as claimed in claim 13, wherein step a) comprises following sub-steps of:

a1) activating a second data collector to output schedule parameters of the air conditioning unit in the past time period;

a2) activating a first data collector to output indoor temperature setting conditions of the building in the past time period;

a3) activating an energy simulation software to output exterior heat loads for the building in the past time period;

a4) activating a third data collector to output weather forecast data in the future time period, wherein the weather forecast data includes an outdoor temperature and a relative humidity in the future time period; and a5) activating an air conditioning load prediction calculator to calculate the predicted load based on the schedule parameters, the indoor temperature setting conditions, the exterior heat loads, and the weather forecast data.

19. The method as claimed in claim 18, wherein the energy simulation software calculates the exterior heat loads based on data including windows opening frequency of the building in the past time period, windows shading factors of the building in the past time period which describe how much sunlight the windows of the building receive during the past time period, and at least one orientation of the building.

20. The method as claimed in claim 18, wherein in step a5) the air conditioning load prediction calculator calculates:

a corresponding outdoor enthalpy based on the weather forecast data;

an indoor enthalpy based on the indoor temperature setting conditions;

a difference between the outdoor enthalpy and the indoor enthalpy;

a ventilation load based on the schedule parameters and the outdoor enthalpy; and the predicted load based on the ventilation load, the difference between the outdoor enthalpy and the indoor enthalpy, and the exterior heat loads.

* * * * *